US005708721A

United States Patent [19]

Salvage et al.

[11] Patent Number: 5,708,721

[45] Date of Patent: *Jan. 13, 1998

[54] COIL ASSEMBLIES

[75] Inventors: Richard James Salvage, Burgess Hill; Steven John Harrington, Steyning; Derek William Powell, Burgess Hill, all of United Kingdom

[73] Assignee: Knowles Electronics Co., Burgess Hill, United Kingdom

[ * ] Notice: The term of this patent shall not extend beyond the expiration date of Pat. No. 5,610989

[21] Appl. No.: 756,277

[22] Filed: Nov. 25, 1996

Related U.S. Application Data

[62] Division of Ser. No. 360,179, Dec. 20, 1994, Pat. No. 5,610,989.

[30] Foreign Application Priority Data

Dec. 21, 1989 [GB] United Kingdom ..... 8928899

[51] Int. Cl.[6] ..... H04R 25/00

[52] U.S. Cl. ..... 381/69; 381/200

[58] Field of Search ..... 381/68, 68.2, 68.3, 381/68.4, 68.5, 68.6, 68.7, 69, 69.2, 194, 200; 379/52; 336/65; 361/749, 752

[56] References Cited

U.S. PATENT DOCUMENTS

| | | | |
|---|---|---|---|
| 1,962,012 | 6/1934 | Grassmann | 381/194 |
| 2,751,444 | 6/1956 | Koch | 336/65 |
| 2,864,064 | 12/1958 | Heaton | 336/65 |
| 2,983,797 | 5/1961 | Lybarger | 381/684 |
| 3,076,062 | 1/1963 | Fener | 381/68.5 |
| 3,124,785 | 3/1964 | Seretny et al. . | |
| 3,413,424 | 11/1968 | Carlson | 381/200 |
| 3,560,667 | 2/1971 | Carlson | 381/200 |
| 3,614,335 | 10/1971 | Edgware et al. | 381/158 |
| 3,627,930 | 12/1971 | Toman . | |
| 3,649,939 | 3/1972 | Hildebrandt | 336/65 |
| 3,721,932 | 3/1973 | Fierstien et al. | 336/65 |
| 4,109,116 | 8/1978 | Victoreern | 381/93 |
| 4,271,333 | 6/1981 | Adams et al. . | |
| 4,291,202 | 9/1981 | Adams et al. . | |
| 4,292,477 | 9/1981 | Adams et al. . | |
| 4,314,220 | 2/1982 | Ito et al. . | |
| 4,331,840 | 5/1982 | Murphy et al. . | |
| 4,404,489 | 9/1983 | Larson et al. . | |
| 4,507,637 | 3/1985 | Hayashi | 336/65 |
| 4,578,664 | 3/1986 | Kinzler et al. . | |
| 4,710,961 | 12/1987 | Buttner | 381/69.2 |
| 4,759,120 | 7/1988 | Berstein | 29/605 |
| 4,764,690 | 8/1988 | Murphy et al. . | |
| 4,783,815 | 11/1988 | Buttner . | |
| 4,868,637 | 9/1989 | Clements et al. | 357/72 |
| 4,890,329 | 12/1989 | Erbe . | |
| 4,912,769 | 3/1990 | Erbe . | |
| 5,101,435 | 3/1992 | Carlson | 381/65.6 |
| 5,193,116 | 3/1993 | Mostardo | 381/69 |
| 5,610,989 | 3/1997 | Salvage et al. | 381/69 |

FOREIGN PATENT DOCUMENTS

| | | |
|---|---|---|
| 3220737 | 12/1983 | Germany . |
| 3502178 | 8/1985 | Germany . |
| 3511802 | 10/1986 | Germany . |
| 3616773 | 11/1987 | Germany . |
| 3615307 | 12/1987 | Germany . |
| 8803351 | 9/1988 | Germany . |
| 57-25797 | 2/1982 | Japan . |
| 57-25798 | 2/1982 | Japan . |
| 58-204509 | 11/1983 | Japan . |
| 59-16493 | 1/1984 | Japan . |
| 59-146293 | 8/1984 | Japan . |
| 0244111 | 10/1987 | Japan . |

*Primary Examiner*—Huyen D. Le
*Attorney, Agent, or Firm*—Wallenstein & Wagner, Ltd.

[57] ABSTRACT

This invention relates to coil assemblies and in particular, but not exclusively, to such assemblies for acoustic transducers. Thus a transducer 10 includes a case 11 in which is located a coil 16 mounted on a flexi-circuit, which locates the coil 16 for its assembly handling and which allows various configurations within the case 11. A method of winding the coil 16 and mounting it on the carrier 17 is also described.

4 Claims, 3 Drawing Sheets

COIL ASSEMBLIES

This is a division of Ser. No. 360,179, filed Dec. 20 1994, now U.S. Pat. No. 5,610,989.

This invention relates to electrical coil assemblies and in particular, but not exclusively, to such assemblies for use in hearing aid transducers.

In many applications, and particularly in the hearing aid industry, there is a need for very small electrical coils made of extremely fine wire. These coils have to be mounted into cases and the fine input and output wires have to be connected to terminals by significantly thicker wires. This results in many assembly problems, because the fine wire can only be manipulated under a microscope and is very liable to break and because, with current winding arrangements, there is no certainty where the leads of the coil may end up after winding. Another complication is that it is generally desirable to produce small coils without any internal former and this means that the coil is difficult to orientate and locate correctly in three-dimensions. (The only reference surfaces are the end faces and the tunnel).

From one aspect the invention consists in a coil assembly comprising a fine wire coil having a set of leads and a carrier incorporating electrical paths extending from a first set of terminals to a second set of terminals, the coil being mounted on the carrier and its leads being connected to the first set of terminals.

In a preferred embodiment the carrier is flexible and may, for example, be constituted by a flexi-circuit. The coil is also preferably formerless and is preferably adhered to the carrier. The connections between the leads of the first set of terminals are preferably formed by welding or some similar arrangement so as to avoid solder flux contamination.

It will be appreciated that once the coil and its leads are both attached to the carrier its orientation is immediately discernable and the assembly can be readily located and manipulated by automatic machinery.

For example, as in a hearing aid transducer, the coil assembly may be located in a case having a slot through which the carrier extends such that its second terminals are external to the case and indeed they may be adhered to an external face of the case. Where the carrier is flexible it will be understood that the carrier can easily be bent to conform to the shape of the case and to pass around other elements of the device of which the coil assembly forms a part thus allowing a great range of configurations. Thus the carrier may extend above the coil or below the coil and its dimensions may be selected to locate particularly the coil within the case. The carrier may have a variety of second terminal configurations to suit the particular company using the devices and indeed the second terminals may be in the form of a plug-in connection.

The invention also includes a method of manufacturing a coil assembly comprising winding a formerless coil, retaining the start and finish leads in predetermined positions, presenting a carrier having a first set of terminals to the coil, mechanically manipulating the start and finish leads from their predetermined positions into contact with the respective first terminals and forming an electrical contact between the leads and the terminals.

Preferably the electrical connection is formed by welding or the like. Once the connection is formed, the coil is mounted on the carrier, for example, by adhesive. Conveniently the coil is wound on a retractable former which can be retracted at any convenient stage in the operation. Thus, in one arrangement, the coils may be suspended by their leads from posts on pallets, the posts retaining the leads and defining their predetermined positions.

Although the invention has been defined above it will be understood it includes any inventive combination of the features set out above or in the following description.

The invention may be performed in various ways and specific embodiments will now be described, by way of example, with reference to the accompanying drawings, in which.

FIGS. 7 and 8, 9 and 10 and 11 and 12 show view from above and one end in respective stages of the connection of a coil and its leads to a carrier.

Figure 1:
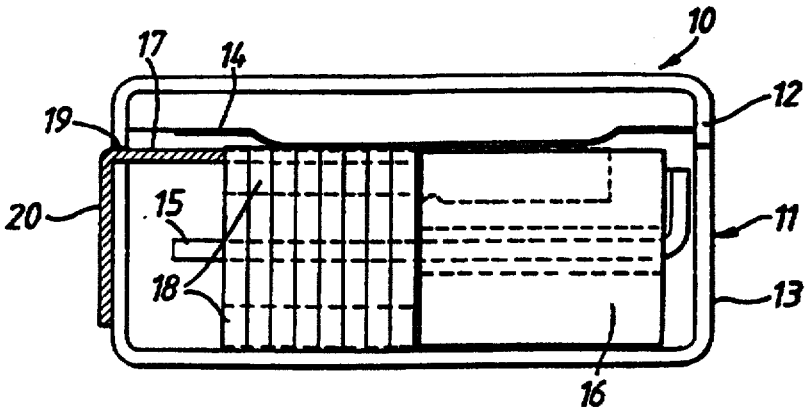
FIG. 1 is a transducer assembly including a coil assembly according to the invention.

In FIG. 1 an acoustic transducer, generally indicated at 10, comprises a case 11, having a top 12 and a bottom 13, a diaphragm 14, a reed 15, a coil 16, mounted on a flexi-circuit carrier 17 and magnets/pole piece assembly 18.

As has been indicated above the coil 16 is formerless so that it can be sufficiently small, whilst accommodating the reed 15, and it is carried on the flexi-circuit 17 by means of connections which will be described in more detail below. The flexible nature of the circuit enables the carrier to be curved downwardly around the coil and to extend out of the case 11, through a slot 19 and to be bent along the external face of the bottom 13 to present terminals 20 for connection to the rest of a device.

Figure 2:
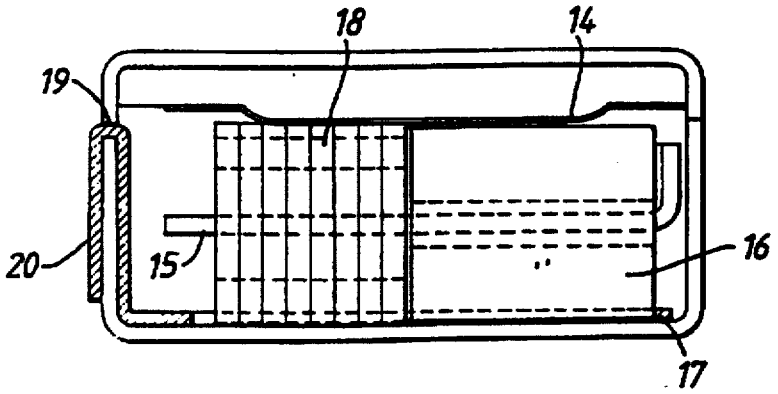
FIGS. 2 to 4 show alternative embodiments of such a transducer.
Figure 3:
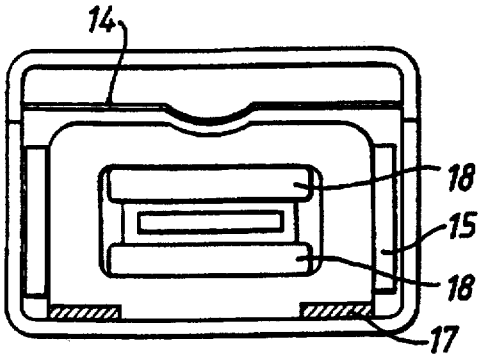
Figure 4:
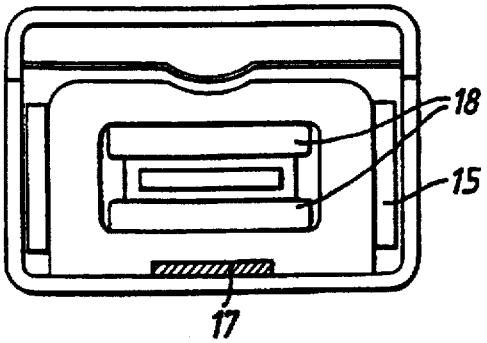

FIGS. 2 to 4 show alternative arrangements of the transducer 19 and they particularly well illustrate the dramatic effect of the use of a flexi-circuit in that it can be bent into various positions and can be formed to accommodate various configurations. This is particularly advantageous when it comes to manufacture, because a batch suitable for any particular use can be made simply by supplying the machine described below with the appropriate flexi-circuits; no change is required in the manufacturing process. In contrast, with the present system, the assembly operatives have to select different pieces to achieve different constructions.

Figure 5:
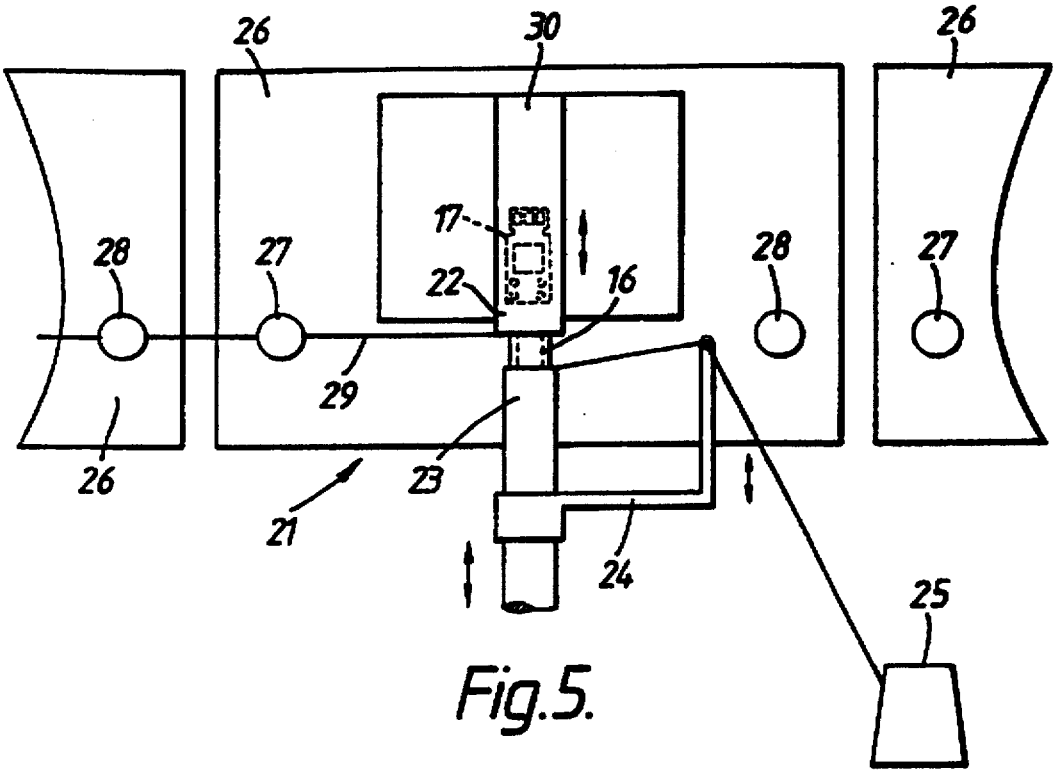
FIG. 5 is a diagrammatic view from above of a winding machine for use in manufacture of the coil assemblies.
Figure 6:
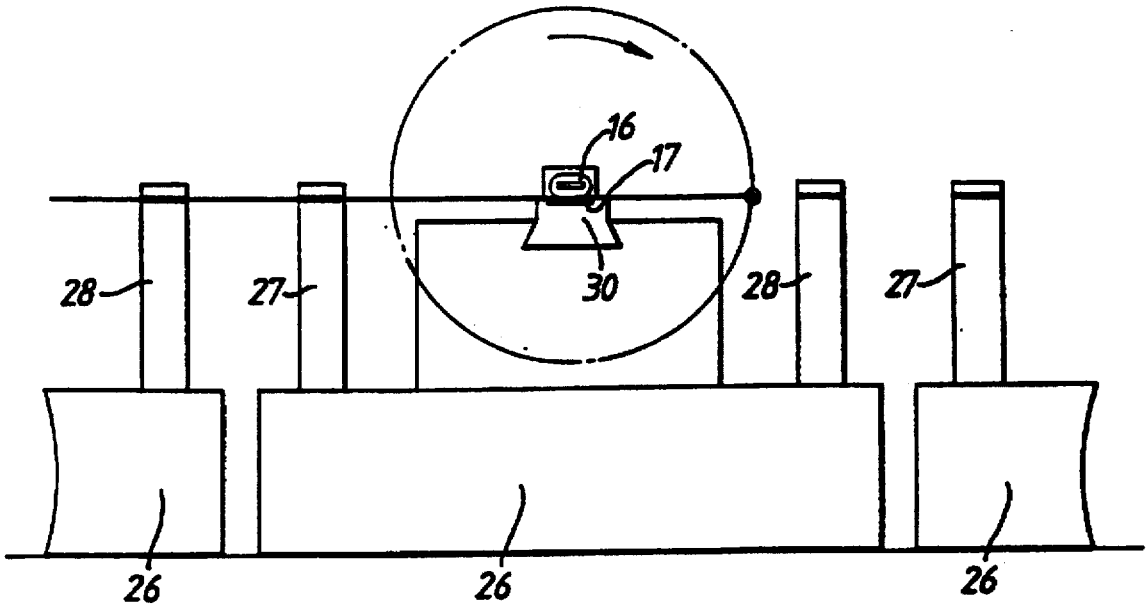
FIG. 6 is an end view of the machine of FIG. 5.
Figure 7:
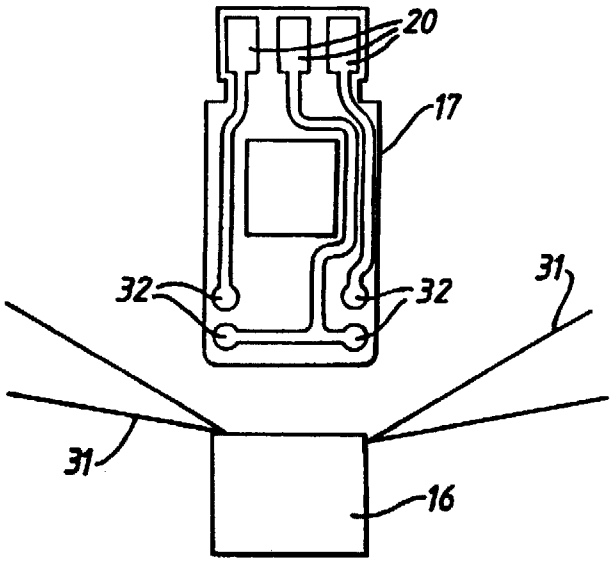
Figure 8:
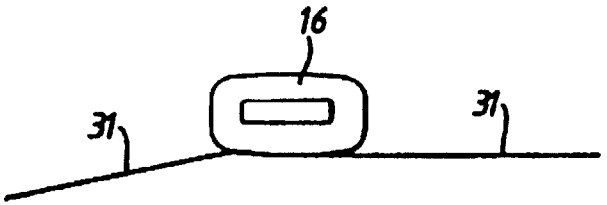
Figure 9:
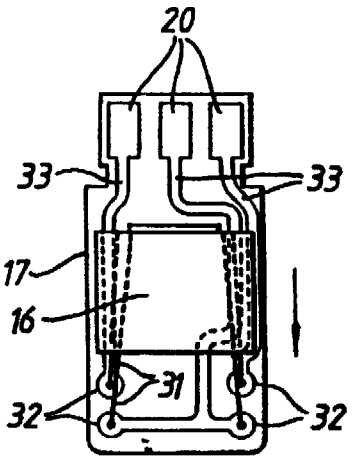
Figure 10:
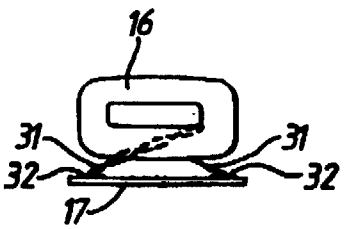
Figure 11:
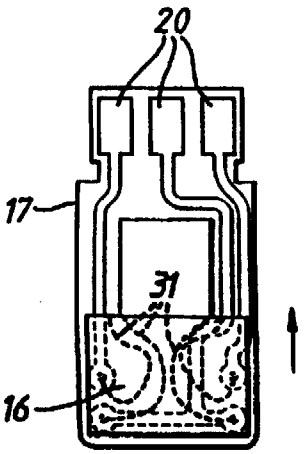
Figure 12:
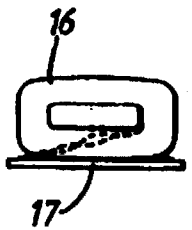

Turning to FIGS. 5 and 6 a winding machine 21 consists of a retractable coil former 22, a retractable tail stop 23, and a fly winder 24 which is retractably mounted on tail stop 23. The fly winder 24 is supplied from a spool 25. The machine 21 is arranged to operate with a series of pallets 26 which pass in this configuration from right to left. These pallets have leading and trailing retaining posts 27 and 28 which pick up the wire 29 as it passes from one coil to the next and retain it so that the posts define the positions of the start and trailing leads of the coil.

Thus in manufacturing a coil 16 is wound on the former 22 by the fly winder 24, having already had its start coil lead retained by the post 27 and once winding is complete the trailing lead becomes entrapped by the trailing post 28.

The pallet 26 would then normally be moved downstream to the next assembly stage, but for convenience a circuit positioning slide 30 is illustrated in winding location. As can be seen this slide holds the flexi-circuit 17 in position in a retracted position until the coil is wound. The slide is then brought forward to position the circuit 17 under the coil 16. Alternatively, the circuit may be presented to the rod after it has been wound; the circuit being fed from a separate dispenser.

Referring now to FIGS. 7 to 12 it will be seen that once the circuit 17 is positioned beneath the coil 16 the leads 31 can be removed from their own positions defined by the posts 27 and 28 by robotic manipulating arms or the like and positioned on terminals 32 on the flexi-circuit 17. They are then preferably welded to the terminals 32 which leaves the coil 16 supported fractionally above the carrier 16. The coil is slid over and against the carrier 17 and the leads 31 brushed beside the coil. An adhesive is then placed between the edges of the coil 16 and the carrier 17. It will be seen that the terminals 32 are connected to terminals 20 by means of electrical paths 33.

As mentioned above it is more likely that the pallets 26 will be passed to a series of lead fixing and coil attaching stations after winding in order to achieve a greater throughput.

The resultant assembly enables the coil to be moved around within the assembly plant without the coil being touched, hence reducing the risk of damage, and they could even be supplied mounted on strips of flexi-circuits. Another advantage is that the connections between the coil and the terminal are protected by the flexi-circuit and the coil. The coil is located three-dimensionally by the flexi-circuit and the connections are formed without the need for thicker lead-out wires or other additional or complicated features as are currently used. The ability to achieve automatic assembly of the coil to its terminals considerably reduces the manufacturing costs and enables the assembly to be constructed in accordance with customer requirements very simply.

We claim:

1. A hearing aid transducer comprising:

a coil assembly including a fine wire coil having a body and a set of leads and a flexible carrier incorporating electrical paths extending from a first set of terminals to a second set of terminals; the coil body being directly mounted by means of an adhesive on the carrier and the leads being electrically connected to the first set of terminals; and a case having a slot through which the carrier extends such that the second set of terminals are external to the case.

2. A hearing aid transducer as claimed in claim 1, wherein the carrier extends above or below the coil.

3. A hearing aid transducer as claimed in claim 1, wherein the carrier is dimensioned to locate the coil within the case.

4. A hearing aid transducer as claimed in claim 1, wherein the coil is formerless.

* * * * *